US006838958B2

(12) United States Patent
Lonsdale et al.

(10) Patent No.: US 6,838,958 B2
(45) Date of Patent: Jan. 4, 2005

(54) ROTARY SIGNAL COUPLER

(75) Inventors: Anthony Lonsdale, Banbury (GB); Bryan Lonsdale, Banbury (GB)

(73) Assignee: Transense Technologies plc (GB)

( * ) Notice: Subject to any disclaimer, the term of this patent is extended or adjusted under 35 U.S.C. 154(b) by 141 days.

(21) Appl. No.: 10/275,347

(22) PCT Filed: May 10, 2001

(86) PCT No.: PCT/GB01/02073

§ 371 (c)(1),
(2), (4) Date: Jan. 21, 2003

(87) PCT Pub. No.: WO01/86749

PCT Pub. Date: Nov. 15, 2001

(65) Prior Publication Data

US 2003/0146812 A1 Aug. 7, 2003

(30) Foreign Application Priority Data

May 10, 2000 (GB) ..... 0011301

(51) Int. Cl.[7] ..... H01P 1/06
(52) U.S. Cl. ..... 333/261; 333/116
(58) Field of Search ..... 333/109, 116, 333/261, 24 R

(56) References Cited

U.S. PATENT DOCUMENTS 2,994,046 A 7/1961 Granqvist
4,327,334 A 4/1982 Becavin et al.
4,730,224 A * 3/1988 Komatsu ..... 360/64
5,157,393 A * 10/1992 Fox et al. ..... 340/870.3
5,192,923 A 3/1993 Komatsu
6,018,279 A * 1/2000 Arthur ..... 333/116

FOREIGN PATENT DOCUMENTS

GB 2 328 086 2/1999
GB 2 350 938 12/2000

* cited by examiner

*Primary Examiner*—Robert Pascal
*Assistant Examiner*—Dean Takaoka
(74) *Attorney, Agent, or Firm*—Keusey, Tutunjian & Bitetto, P.C.

(57) ABSTRACT

The present invention relates to a rotary signal coupler, that is to say a device for providing signal coupling between two components which are rotatable relative to each other. A coupler is provided comprising a first substantially circular track secured to a first support and a second substantially circular track secured to a second support which is rotatable relative to the first support. The first and second tracks are coaxial with the axis of rotation of the rotatable second support and are adjacent each other so as to provide signal coupling therebetween. The second track has at least two gaps therein which form electrical discontinuities between separated track portions. The separated track portions are electrically connected to one another. Signal coupling with a rotatable support having a relatively large diameter may be thereby improved.

17 Claims, 3 Drawing Sheets

ROTARY SIGNAL COUPLER

FIELD OF THE INVENTION

This invention relates to a rotary signal coupler, that is to say a device for providing signal coupling between two components which are rotatable relative to each other.

DESCRIPTION OF RELATED ART

Published International patent application WO 91/13832 describes a strain measuring method and apparatus particularly suitable for measuring the torque applied to a shaft. The described method and apparatus make use of a surface acoustic wave (SAW) device mounted on the shaft. Such devices require the passage of high frequency, typically radio frequency (RF), signals between the SAW device and its associated drive/measuring circuitry. If the shaft to which the SAW device is attached rotates only through a small angular range, the SAW device may be hard wired to its associated drive/measuring circuitry. There are, however, many applications of the torque measuring technique described in WO 91/13832 which are not susceptible to hard wiring between the SAW device and its associated drive/measuring circuitry, and such applications require the use of a rotary signal coupling device in order to effect the required connection.

Published International patent application WO 96/37921 discloses a rotary signal coupling device which may be used to provide the required coupling to a SAW device at RF frequencies. The described device includes a pair of transmission lines, each comprising an electrically conductive track and an associated ground plane. The tracks are each substantially circular, but each defines a gap so that each track forms with its associated ground plane a transmission line. The tracks are arranged coaxially about the shaft carrying the SAW device, one track and its associated ground plane being secured to the shaft whilst the other track and its associated ground plane is secured to a bearing through which the shaft passes. The tracks are separated by a thin sheet of dielectric material, or by a small air gap. One end of the track secured to the bearing is connected to the drive/measuring circuitry and one end of the track which is secured to the shaft is connected to the SAW device, The ends of the tracks opposite to their respective connections to the drive circuitry and the SAW device may be earthed or may be left open circuit.

The above described rotary signal coupler has a characteristic impedance which is substantially constant over a wide frequency range. However, the device has been found to be unsatisfactory in that both the phase variation and attenuation of signals passing though the coupler have been found to be dependent upon the relative rotational positions of the fixed and movable parts of the coupler. These phase variations and attenuation variations are highly undesirable since they significantly complicate the interpretation of the signals derived from the SAW device.

Published UK patent application GB 2 328 086A discloses a rotary signal coupler having a capacitor coupled across the gap between one or both of the tracks. This significantly reduces the problem of variable phase and variable attenuation.

However, although the couplers described in GB 2 328 086A operate satisfactorily on small diameter shafts (i.e. shafts having a diameter of 20 mm or less), said couplers do not appear effective when used with larger diameter shafts. In particular, the coupler having stator and rotor tracks mounted in adjacent parallel planes (see FIG. 1 of the accompanying drawings) has proved unsuitable for use with shaft diameters of 75 mm or more. This arrangement is limited by the wavelength of the RF signal to be passed through the coupler. Furthermore, the diameters of the coupler stator and rotor tracks are dependent upon the velocity constant of the structure (wherein the velocity constant is the square root of a medium's dielectric constant). Although the aforementioned arrangement may be adapted in favour of larger diameter shafts by using low dielectric materials and by thus increasing the velocity constant, the improvements are small and do not allow satisfactory performance on shafts having a diameter of 75 mm or more.

The present invention provides a rotary signal coupler comprising: a first substantially circular track secured to a first support; a second substantially circular track secured to a second support which is rotatable relative to the first support, the first and second tracks being coaxial with the axis of rotation of the rotatable second support and being adjacent each other to provide signal coupling therebetween; a first terminal connected to the first track; a second terminal connected to the second track; wherein one of said tracks has at least two gaps therein which form electrical discontinuities between separated track portions, the separated track portions being electrically connected to one another.

SUMMARY OF THE INVENTION

The above and further features and advantages of the present invention will become clear from the following description of preferred embodiments thereof given by way of example only, reference being had to the accompanying drawings wherein:

FIG. 1 illustrates schematically a prior at rotary signal coupler disclosed in GB 2 329 086A;

FIG. 2 illustrates schematically a rotor of a first embodiment of the present invention;

FIG. 3 illustrates schematically the electric circuitry associated with the rotor of FIG. 2; and FIG. 4 illustrates schematically the electric circuitry associated with a stator of the first embodiment.

BRIEF DESCRIPTION OF THE DRAWINGS

Referring firstly to FIG. 1, the illustrated prior art coupler 1 is shown schematically for providing signal coupling between a coax cable 2 and a coax cable 3. In the illustrated coupler, the coax cable 2 is connected to a driver/measuring circuit and the coax cable 3 is connected to a SAW device 4 mounted on a shaft 5. The coupling accordingly facilitates signal connection between the driver/measuring circuit and the SAW device for the purpose of measuring torque applied to the shaft 5.

The coupler 1 comprises a first part 6 which is secured to a fixed support by appropriate means and a second part 7 which is secured to the shaft 5. The parts 6,7 face each other and, in practice, are separated either by a small air gap or by a thin sheet of insulating material. The separation of the parts 6,7 has been exaggerated in the drawing so that the structure of the part 6 may be seen clearly. In practice, the parts 6,7 are likely to be separated by a small amount, typically 1 to 5 mm.

DETAILED DESCRIPTION OF PREFERRED EMBODIMENTS

Figure 1:
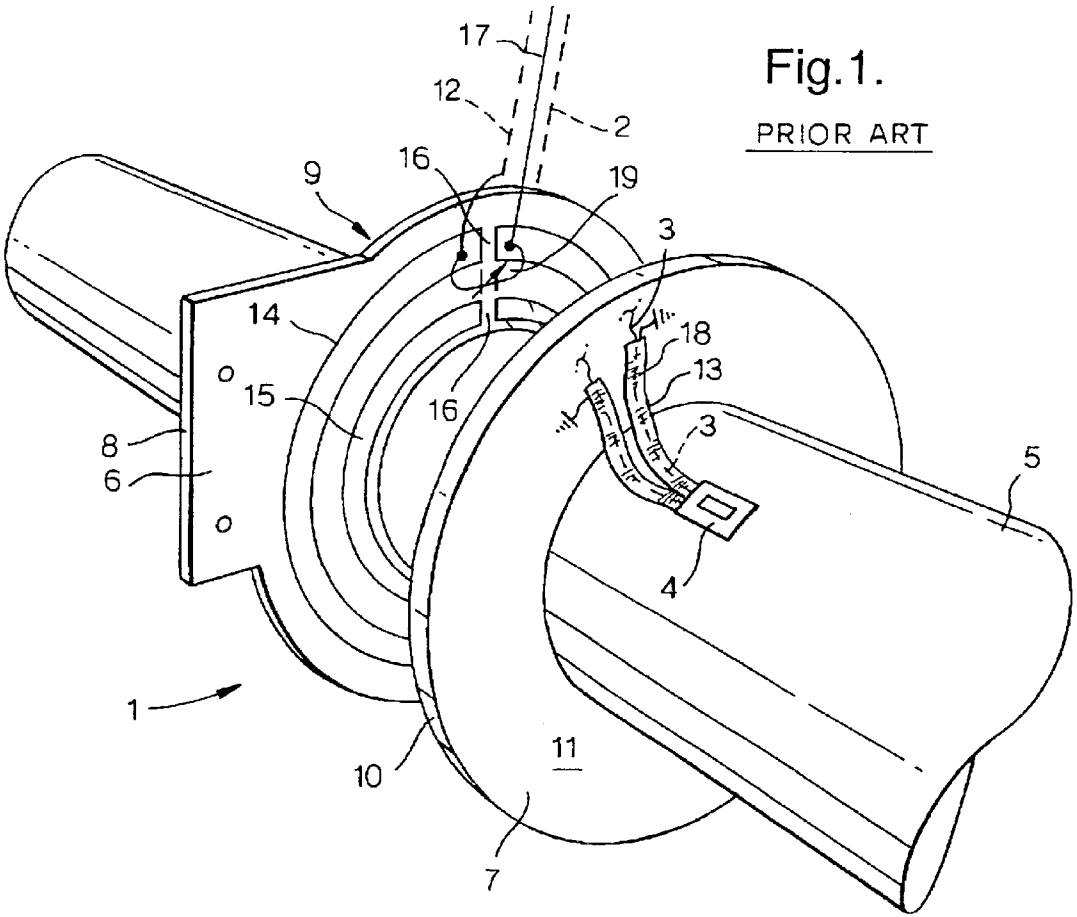
Fig. 1. PRIOR ART

The member 6 comprises a sheet 8 of insulating material which supports, on the side thereof remote from the part 7, a metal screen 9. Similarly, the part 7 comprises a sheet 10 of insulating material which supports, on the side thereof remote from the part 6, a metal screen 11. The screen 9 will, in many applications, be earthed, e.g. by way of connection to the screen 12 of the coax cable 2. The screen 11 will, in general, be electrically connected to the shaft 5, e.g. by way of the screen 13 of the coax cable 3. The shaft 5 will in general be earthed and accordingly the screens 9 and 11 are electrically connected.

The first part 6 has formed thereon two annular tracks 14,15. In a basic arrangement, only one track will be present, but in more complicated arrangements, several additional tracks may be present. Additional tracks may be used for signal coupling to additional devices. For example, if two separate SAW devices are secured to the shaft, two separate tracks would be used to provide coupling to them.

The tracks 14,15 may be of any suitable material, for example copper foil.

The tracks 14,15 are in the form of complete circles except for a gap 16 which forms an electrical discontinuity in each track. One end of the track 14 is connected to the core 17 of the coax cable 2. If an additional track, for example the track 15, is used, it will have associated therewith appropriate cable connections. For the purposes of illustration, only the outer track 14 is shown connected to a cable. In the illustrated coupler, the end of the track 14 opposite to the connection to the core 17 is connected to the screen 12 of the coaxial cable and to the screen 9. However, alternative arrangements may be desirable. For example, the end of the track remote from the connection to the coaxial cable may be left open circuit (except for the additional capacitor referred to below).

The face of the part 7 adjacent the part 6 has formed thereon tracks which mirror those of the part 6, as described above. One end of the outer track of the part 7 is connected to the core 18 of the coax cable 3, and the opposite end of that track is connected to the screen 13 of the coax cable 3 and to the screen 11 of the part 7. As with the track 14 of the part 6, said track of the part 7 may be left open circuit at the end opposite the connection to the core 18.

Each track 14 has connected across the gap 16 a capacitor. The capacitor may be a fixed capacitor or a variable capacitor permitting some adjustment to the capacitance of the circuit. The size of the capacitor will be selected so that the circuit is tuned to a slightly broader bandwidth than the frequency band expected to be encountered in use of the apparatus. The object is to tune the circuit to a small extent, but to leave the bandwidth broad enough to provide substantially constant coupling characteristics over the entire expected use frequency range. Typically, where the screens 9,11 are earthed, the supports 8,10 have a thickness of 1.5 mm, the outer track 14 has an inside diameter of 40 mm and a radial extent of 5 mm, the value of the capacitor 19 will be approximately 30 PF. This figure is similar to the capacitance between the track and the screen 9,11. Such a device would typically have substantially uniform transmission characteristics over the frequency range 185–215 MHz.

Each track of each pair of mating tracks may be furnished with a capacitor of substantially the same value. Further, although as illustrated the capacitor 19 is physically positioned on the parts 6,7 it is possible for the capacitor to be physically located remote from the part and electrically connected across the gap 16 by, for example, being electrically connected between the core and the screen of the associated coax cable.

Figure 2:
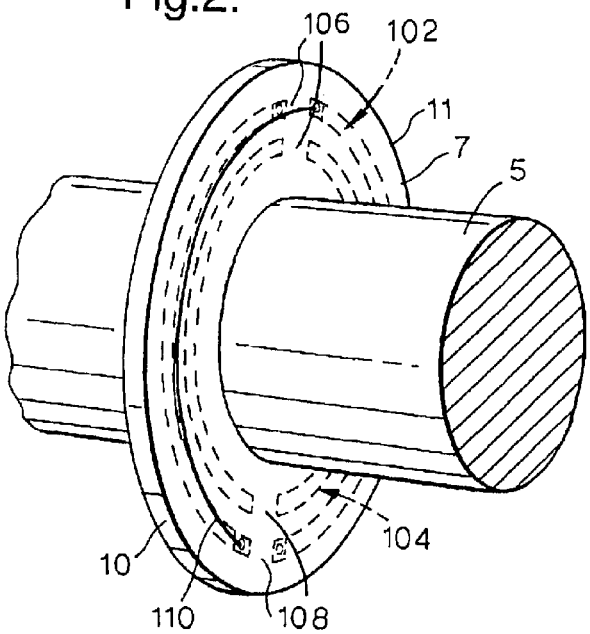
Figure 3:
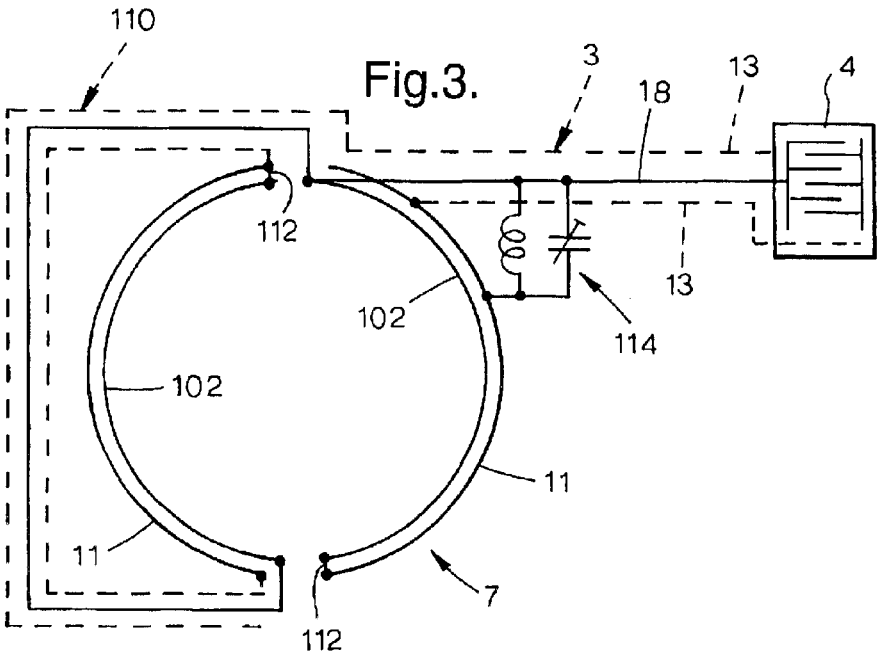
Figure 4:
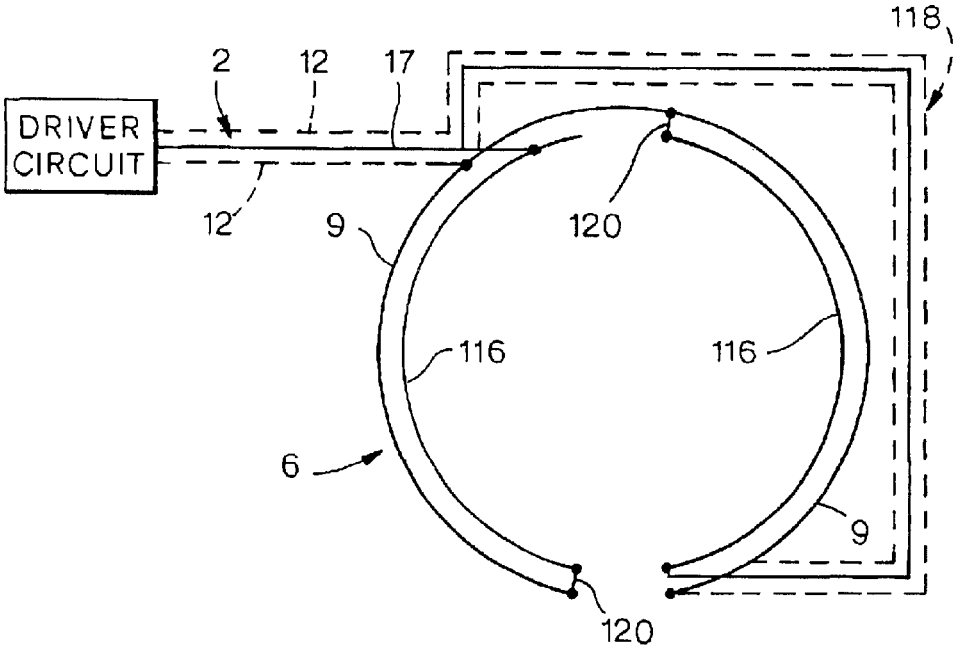

Referring now to FIGS. 2 to 4, components of an improved rotary signal coupler are illustrated. Apart from the improvements discussed below, the improved coupler is identical to the prior art coupler shown in FIG. 1 and, accordingly, like elements have been labelled with like reference numerals in the accompanying drawings.

In FIG. 2, a rotor part 7 of an improved coupler is shown. For the purposes of clarity however, the SAW device 4 (attached to the shaft 5) and associated coax cable 13 are not illustrated. The rotor part 7 of the improved coupler differs from that of the prior art coupler shown in FIG. 1 in that the tracks 102,104 (mounted on the planar surface of the part 7 hidden from view in FIG. 2) are divided into two halves. Since the tracks 102,104 are provided on a hidden surface in FIG. 2, said tracks 102,104 are illustrated in FIG. 2 with broken lines.

It will be seen that the arrangement of the tracks 102,104 in two halves results in each track having two gaps 106,108. In the illustrated embodiment, the two halves of the outer track 102 are connected to one another by means of a coax cable 110 mounted on a semi-circular path on the planar surface of the part 7 visible in FIG. 2. Connecting means (not shown in FIG. 2) are provided for electrically connecting the coax cable 110 to the two halves of the outer track 102 through the thickness of the part 7. The coax cable 110 is connected at a first end thereof to a first end portion of a first semi-circular half of the outer track 102. A second end of the coax cable 110 (distal to said first end of the coax cable 110) is connected to a first end portion of a second semi-circular half of the outer track 102. The first end portions of the first and second semi-circular halves of the outer track 102 are diametrically opposed to one another. For each of the semi-circular halves of the outer track 102, the second end portion (distal to the first end portion to which the coax cable 110 is connected) is connected through the thickness of the part 7 to the screen 11. These connections are indicated in the schematic electric circuit diagram of FIG. 3 by reference numeral 112. As in the coupler of FIG. 1, the screen 11 of the present embodiment is connected to earth via the screen 13 of the coax cable 3 (see FIG. 3). Also, a variable capacitor 114 is connected to the second end portions of the two semi-circular halves of the outer track 102. The use of a capacitor is however optional.

In the illustrated embodiment, the inner track 104 is not connected to a SAW device and the two semi-circular halves thereof are not connected to one another. The inner track 104 and indeed further tracks may however be connected as described above with regard to the outer track 102. In this way, the coupler may be used with more than one SAW device.

As in the coupler of FIG. 1, the improved coupler shown in the accompanying drawings incorporates a stator part 6 (see FIG. 4) mounted to a bearing arrangement (not shown) in which the shaft 5 may rotate. However, the stator part of the improved coupler differs to the stator part of the prior art coupler in that the tracks 116 mounted thereon are provided in two semi-circular halves. These semi-circular halves are arranged as mirror images of the cooperating semi-circular track halves mounted on the rotor part 7 and are connected to one another by a coax cable 118 as described above with reference to the rotor part 7. Furthermore, the coax cable 118 is located on an opposite side of the stator part 6 to the track 116, the coax cable 118 and first end portions of the semi-circular track halves being electrically connected to one another through the thickness of the stator part 6 by appropriate means.

For each of the semi-circular halves of the track 116, a second end portion (distal to the first end portion to which the coax cable 118 is connected) is connected through the thickness of the part 6 to the screen 9. These connections are indicated in FIG. 4 by reference numeral 120. As in the coupler of FIG. 1, the screen 9 of the present embodiment is connected to earth via the screen 12 of the coax cable 2. A capacitor may be connected to the two track halves, although no capacitor is provided with illustrated stator part 6.

The present invention is not limited to the specific embodiment described above. Alternative arrangements and suitable materials will be apparent to a reader skilled in the art. For example, the tracks mounted on the stator and rotor parts may be provided with more than two gaps. The tracks may thus be divided into thirds or quarters or be otherwise divided. Indeed, one of the stator or rotor parts may be provided with tracks arranged in a conventional manner (for example, with a track having only a single gap).

What is claimed is:

1. A rotary signal coupler comprising: a first substantially circular track (116) secured to a first support; a second substantially circular track (102) secured to a second support which is rotatable relative to the first support, the first and second tracks (116,102) being coaxial with the axis of rotation of the rotatable second support and being adjacent each other to provide signal coupling therebetween; a first terminal connected to the first track (116); and a second terminal connected to the second track (102); characterized in that one of said tracks (102) has at least two gaps (106,108) therein which form electrical discontinuities between separated track portions, an input/output transmission line (3) being electrically connected to one of said track portions via one of said terminals and each remaining separated track portion being electrically connected to the input/output transmission line by means of one or more further transmission lines (110) wherein each further transmission line extends between and electrically connects two separated track portions.

2. A rotary signal coupler as claimed in claim 1, wherein said input/output transmission line (110) is mounted on an associated support, the associated support being that support to which said connected track portions are secured.

3. A rotary signal coupler as claimed in claim 2, wherein said input/output transmission line (110) extends through the thickness of said associated support and locates on a side of said support opposite to that side of said support to which said track portions are secured.

4. A rotary signal coupler as claimed in claim 2, wherein said input/output transmission line (110) extends in a substantially semi-circular path.

5. A rotary signal coupler as claimed in claim 1, wherein said one of said tracks has two gaps (106,108) which provide two separated track portions substantially semi-circular in shape.

6. A rotary signal coupler as claimed in claim 5, wherein a first end of said input/output transmission line (110) is connected to a first end portion of one of said track portions and wherein a second end of said input/output transmission line (110) is connected to a first end portion of the other one of said track portions, the first end portions of the two track portions being diametrically opposite one another.

7. A rotary signal coupler as claimed in claim 1, wherein said transmission line (110) comprises a coax cable.

8. A rotary signal coupler as claimed in claim 1, wherein said input/output transmission line is electrically connected to one of the separated track portions via one of said terminals.

9. A rotary signal coupler as claimed in claim 1, wherein the other of said tracks (116) has at least two gaps therein which form electrical discontinuities between separated track portions, the separated track portions being electrically connected to one another.

10. A rotary signal coupler as claimed in claim 9, wherein the first and second tracks (116,102) are arranged as mirror images of one another, the first track (116) comprising separated track portions electrically connected to one another in the same way as the separated track portions of the second track (102) are electrically connected to one another.

11. A rotary signal coupler substantially as hereinbefore described with reference to the accompanying drawings.

12. A rotary signal coupler comprising:

a first track (116) secured to a first support;

a second track (102) secured to a second support which is rotatable relative to the first support, the first and second tracks (116,102) being coaxial with an axis of rotation of the rotatable second support and being disposed relative to each other to provide signal coupling therebetween;

a first terminal connected to the first track (116) and a second terminal connected to the second track (102) such that one of the tracks (102) has at least two gaps (106,108) therein which form electrical discontinuities between separated track portions; and an input/output transmission line (3) electrically connected to one of the separated track portions via one of the terminals and each remaining separated track portion being electrically connected to the input/output transmission line by a further transmission line (110) wherein the further transmission line extends between and electrically connects two separated track portions.

13. A rotary signal coupler as claimed in claim 12, wherein the input/output transmission line (110) is mounted on an associated support, the associated support being that support to which said connected track portions are secured.

14. A rotary signal coupler as claimed in claim 13, wherein the input/output transmission line (110) extends through the thickness of said associated support and locates on a side of said support opposite to that side of said support to which said track portions are secured.

15. A rotary signal coupler as claimed in claim 1, wherein a first end of the input/output transmission line (110) is connected to a first end portion of one of the track portions and wherein a second end of the input/output transmission line (110) is connected to a first end portion of the other one of the track portions, the first end portions of the two track portions being diametrically opposite one another.

16. A rotary signal coupler as claimed in claim 12, wherein the other of the tracks (116) has at least two gaps therein which form electrical discontinuities between separated track portions, the separated track portions being electrically connected to one another.

17. A rotary signal coupler as claimed in claim 16, wherein the first and second tracks (116,102) are arranged as mirror images of one another, the first track (116) comprising separated track portions electrically connected to one another in the same way as the separated track portions of the second track (102) are electrically connected to one another.

* * * * *